US006502696B2

(12) United States Patent
Heinrichs

(10) Patent No.: US 6,502,696 B2
(45) Date of Patent: Jan. 7, 2003

(54) STRAPLESS PALLET

(75) Inventor: Mark A. Heinrichs, Brielle, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/774,077

(22) Filed: Jan. 31, 2001

(65) Prior Publication Data

US 2002/0100707 A1 Aug. 1, 2002

(51) Int. Cl.[7] ..... B65D 85/20; B65D 19/00; F42B 39/00; A47F 7/00

(52) U.S. Cl. ..... 206/443; 108/55.3; 206/386; 206/3; 211/59.4

(58) Field of Search ..... 206/3, 443, 446, 206/386; 108/55.3; 211/59.4, 60.1

(56) References Cited

U.S. PATENT DOCUMENTS 3,163,289 A * 12/1964 Laffkas et al. ..... 206/443
3,590,752 A * 7/1971 DePew ..... 108/55.3
4,385,695 A * 5/1983 Champlin et al. ..... 206/443
4,610,362 A * 9/1986 Remp et al. ..... 211/59.4
4,630,746 A 12/1986 Fortenberry
4,706,822 A * 11/1987 Remp, Jr. et al. ..... 211/59.4
4,832,196 A * 5/1989 Butler ..... 206/443
5,060,810 A * 10/1991 Jones ..... 211/59.4
5,351,629 A 10/1994 Breezer et al.
5,433,322 A * 7/1995 Williams ..... 206/443
5,649,632 A * 7/1997 Terashima et al. ..... 211/59.4
5,769,003 A 6/1998 Rose et al.
5,862,931 A 1/1999 Cox et al.
6,261,037 B1 * 7/2001 Richards et al. ..... 410/36

* cited by examiner

*Primary Examiner*—Bryon P. Gehman
(74) *Attorney, Agent, or Firm*—Mark Homer

(57) ABSTRACT

A pallet has a bottom frame with saddles conforming to two generally cylindrical objects, such as bombs, and has a plurality of A-frames disposed at each side and transversely oppositely of the bombs. The wider portion of each A-frame is mounted on the bottom frame for pivotal movement about an axis parallel to the axis of the bombs. The narrower portion of each A-frame has a captive cap screw disposed to extend vertically when the A-frame is pivoted into an upright position beside an adjacent bomb. The pallet has a top frame having inverted saddles conforming to the bombs; has a member which extends across the bombs at the positions of lifting lugs protruding radially from the bombs and which has slots to receive and engage the lifting lugs; and has pockets disposed to receive the cap screws. The bottom frame and the A-frames are configured so that the A-frames may pivot into the bottom frame when the pallet is empty.

9 Claims, 3 Drawing Sheets

STRAPLESS PALLET

BACKGROUND OF THE INVENTION (1) Field of the Invention

The present invention relates to horizontally supported planar surfaces in an industrial platform or pallet with structure to prevent an article thereon from shifting about or falling therefrom, the structure having a load-receiving surface recessed to bear a typically cylindrical article and restrain the article against relative movement. The invention is particularly related to such a pallet having elements for folding the pallet, without element destruction or stress beyond elastic limits, from and into a compact configuration for shipping the empty pallet. The invention is further related to such a pallet having separate sections assembled together to contain the article and having fastening elements, which are an integral part of the pallet, for holding the unfolded pallet in its set-up position.

(2) Description of the Related Art

Pallets commonly require that articles placed thereon be manually maneuvered into position, as into recesses conforming to articles to which the pallets are specifically adapted. This is dangerous and fatiguing with relatively heavy articles, the danger being greater with hazardous materials. Typically, the articles are then restrained to the pallet for shipping by structure, such as strapping, which is not a part of the pallet and is discarded after shipping. Steel or synthetic strapping is commonly used for this purpose although its installation and removal requires not only the strapping itself but steel seals, tensioners, a double notcher or crimper, and shears to cut the strapping. It is evident that the strapping and removal operations are time consuming, waste generating, and are a hazardous operation from the standpoint of cuts and eye injuries.

These deficiencies are particularly inconvenient with bombs which are typically shipped two to a pallet. A further deficiency with prior art bomb pallets involves handling lugs which protrude radially from the generally cylindrical bomb exterior and are for lifting the bomb. In prior art pallets using strapping, these lugs are received in recesses in the pallet so that the bomb, which is lowered onto and removed from the pallet with the lugs in an upward or 12 O'clock position, must be barred to rotate the lugs downward to and, on unloading, from the typical 5 or 7 O'clock position of the recesses. Such rotation is time consuming, physically demanding and potentially hazardous.

A prior art bomb pallet consists of a bottom frame and a top frame between which the bombs are received. To accommodate the bombs, the bottom frame incorporates saddles and the before-mentioned bomb lug pockets. The bottom frame also has fork pockets for handling by conventional handling equipment. The top frame allows the stacking of loaded bomb pallets and also incorporates saddles conforming to the loaded bombs. After positioning the bombs and then the upper frame on the bottom frame, the frames with the bombs therebetween are tied together with steel strapping.

The following four United States patents show other related art, none of these patents disclosing elements for retaining an article to a pallet or within a container:

U.S. Pat. No. 4,630,746 issued Dec. 23, 1986 shows a collapsible shipping container with pivoting members connecting opposite side walls;

U.S. Pat. No. 5,351,629 issued Oct. 4, 1994 shows a pallet with rigid decks connected by a bolt, corresponding to a bottom frame;

U.S. Pat. No. 5,769,003 issued Jun. 23, 1998 shows a pallet which corresponds to such a bottom frame and receives a plurality of parallel cylindrical objects disposed axially perpendicular to the pallet; and U.S. Pat. No. 5,862,931 issued Jan. 26, 1999 shows walls pivoted at a base by non-load bearing hinges for collapsing the walls into a compact configuration. In an upright configuration, the walls are connected by pins and to a lid to form a complete enclosure.

SUMMARY OF THE INVENTION

The invention is concerned with a pallet having a bottom frame and a top frame which are separable and which receive an article or articles between them, the frames being urged together to retain the frames and articles in a shipping configuration. These frames conform to the articles which may be of any configuration but are typically cylindrical articles such as two aircraft bombs. The frames may be provided with conventional fork pockets, lifting eyes and stacking pins.

More specifically, the frames have recesses or saddles spaced axially along and conforming to each article. The articles, such as conventional bombs, may have radially protruding lifting lugs; and the upper frame has a member extending across the bombs at the position of the lugs. This member has slots disposed to receive the lifting lugs so that the upper frame engages the lugs and retains the bombs in a position with the lugs upward when the frames are connected with the bombs therebetween.

The frames are so connected by a plurality of A-frames disposed at each side of the lower frame and transversely oppositely of the bombs. The wider portion of each A-frame is mounted on the bottom frame for pivotal movement about an axis parallel to the axis of the bombs. The narrower portion of the A-frame has a captive cap screw disposed so as to extend vertically when the A-frame is pivoted into a position which is upright in relation to the bottom frame and is beside the one of the bombs adjacent to the A-frame. The top frame has pockets disposed to receive the cap screws when the top frame is disposed on the bombs and the A-frame is in the upright position, so that tightening the screws urges the upper and lower frames together against the bombs.

To use the pallet, the A-frames are first pivoted outwardly of the lower frame for convenient lowering of the bombs onto the lower saddles, as by apparatus engaging the lifting lugs with the lugs in an upward or 12 O'clock position. The top frame is then placed on the bombs with the lugs remaining in this position and the lugs inserted into the before-mentioned slots. The A-frames are then pivoted into their upright positions with the cap screws in the top frame pockets, and the cap screws tightened to retain the bombs, or other articles to which the pallet may be adapted, and the frames in a loaded configuration without the use of strapping. In this configuration, the A-frames retain the top frame in its position axially of the bombs and in relation to the bottom frame.

The bottom frame of the pallet has lengthwise members which typically extend along the axes of cylindrical articles to which the pallet is adapted. The lengthwise members are connected by crosswise members spaced along the lengthwise members so as to define empty regions between the lengthwise members and between opposite A-frames. The A-frames are pivotally mounted on the lengthwise members so that each A-frame may be pivoted into the corresponding empty region, and the top frame then placed directly on the lower frame. The frames are thus disposed in a compact configuration for shipping the empty pallet. The frames are provided with pins and openings therefor to maintain the relative lengthwise and crosswise positions of the frames when the pallet is in this empty configuration.

The bottom and top frames are configured so that several of the pallets may be stacked in engaging relation in either the loaded or the empty configuration.

It is an object of the present invention to provide a pallet wherein articles to be shipped are retained and the pallet assembled without the use of strapping.

Another object is to provide such a pallet wherein articles having lifting lugs are so retained with the lugs in a conveniently accessible position.

Still another object is to provide such a pallet which folds into a compact arrangement when empty.

Yet another object is to provide such a pallet wherein the above objects are provided by conveniently connected pivoting elements.

An additional object is to provide such a pallet which is adapted for a plurality of articles, but may be used for a single article.

A further object is to provide such a pallet which has the foregoing advantages, which may be maneuvered by conventional handling equipment, which is economical to construct, and which is fully effective.

BRIEF DESCRIPTION OF THE DRAWINGS

These and other objects, advantages, and novel features of the present invention will be apparent from the following detailed description when considered with the accompanying drawings wherein.

DETAILED DESCRIPTION OF THE INVENTION

Figure 1:
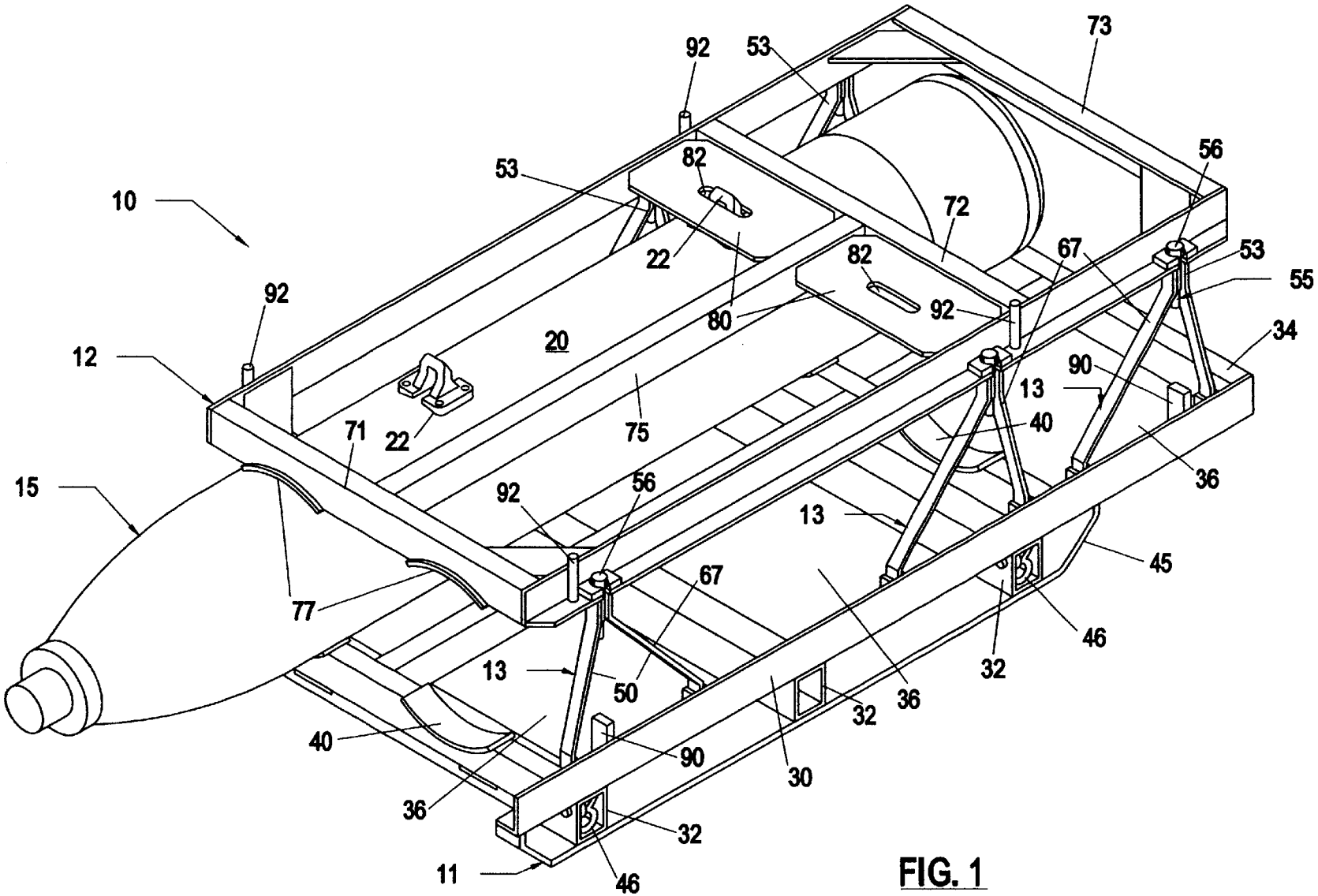
FIG. 1 is an isometric view of a strapless pallet which embodies the principles of the present invention and is adapted for two articles, the pallet being depicted in an article shipping arrangement with one article.

Referring more particularly to the drawings, in FIG. 1 is shown a strapless pallet indicated generally by numeral 10 and embodying the principles of the present invention. The pallet includes a bottom frame which is indicated generally by numeral 11 and is sometimes referred to in the claims as a "first member", a top frame which is indicated generally by numeral 12 and is sometimes referred to in the claims as a "second member", and a plurality of A-frames which are indicated generally by numeral 13 and are sometimes referred to in the claims as "connecting members".

Figure 2:
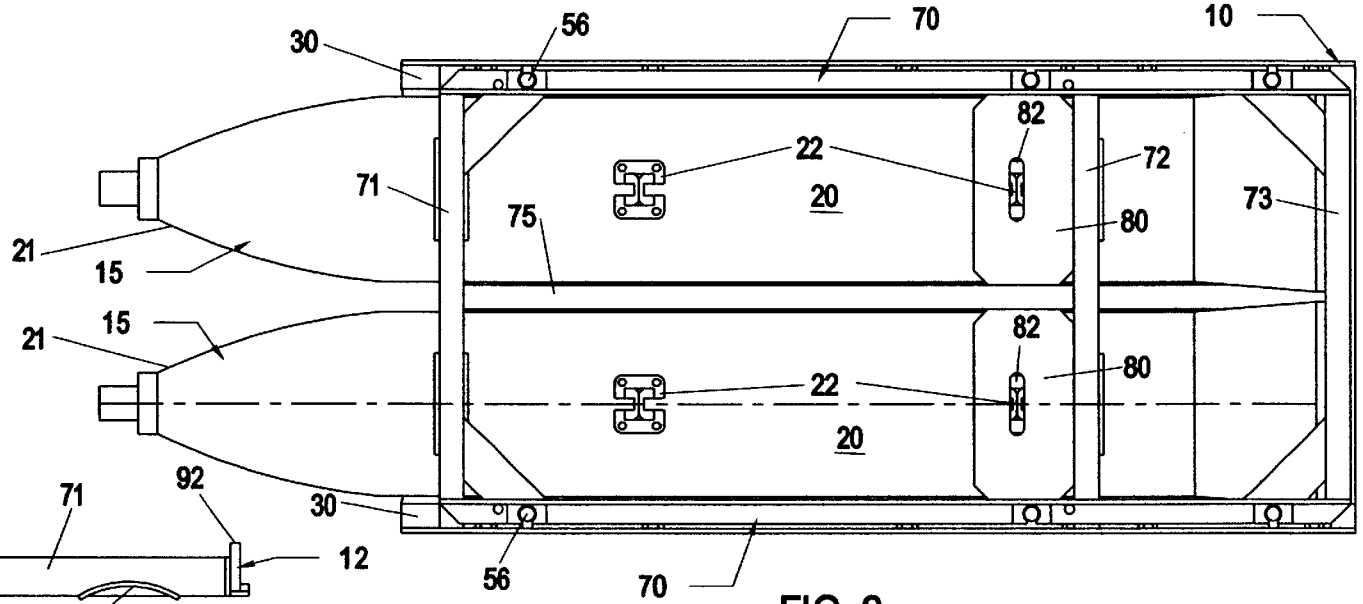
FIG. 2 is a plan view of the pallet in an article shipping arrangement with two articles.

In FIG. 1, the pallet is shown in an article shipping arrangement or configuration wherein the pallet retains between the frames a single article 15, although the pallet may be adapted to retain two such articles as shown in FIG. 2. The article or articles are represented as being generally cylindrical and as typical aircraft bombs of 2000 pounds (about 909 kilograms) weight partially disassembled for shipping.

A pallet of the present invention is well-adapted for such articles, but it will be apparent that the principles of the present invention are applicable to pallets for retaining and shipping other articles, including other types of cylindrical articles and articles which may be of rectangular or irregular configuration. Also, the elements of pallet 10 may be constructed in any suitable manner although the presently described embodiment, with frames 11 and 12 and the connecting members 13 of A-frame configuration, is well-adapted for assembly of these elements by welding from conventional steel structural materials, a construction suitable structurally and economically for shipping the above-described bombs 15.

As best seen in FIGS. 1 and 2, articles or bombs 15, have predetermined configurations with generally cylindrical circumferences 20 and with an ogival nose portion 21. Each bomb has a pair of lifting lugs 22 which extend radially from its cylindrical circumference. These lugs, each of which is referred to in the claims as a "handling element", are disposed in the same plane and are spaced successively from the nose portion at predetermined positions axially of the bomb. The side 25 of the bomb from which the lugs extend is upwardly disposed when pallet 10 is used to ship the bombs and this side is referred to in the claims as "another side" or a "top portion" of the bomb while the opposite side 26 is referred to in the claims as "one side" or a "bottom portion, the bomb having a pair of transversely opposite portions or sides 27 disposed between such bottom portion and such top portion.

It can be seen from the Figures that bottom frame 11 is of generally planar configuration and includes a pair of longitudinal angle members 30 extending parallel to the axes of a bomb or bombs 15 when loaded in and retained on the pallet in article shipping arrangements with frames 11 and 12 as shown in FIGS. 1 and 2. Members 30 are spaced so as to be oppositely outward of the outward opposite sides 27 of the two bombs when in such an arrangement. Members 30 are connected by three transverse tubular members 32 disposed below members 30. One member 32 is disposed at a pair of adjacent ends of members 30 and the other two of the members 32 are spaced therefrom along members 30. The other ends of members 30 are connected by a fourth transverse member 34 spaced from the members 32. It is evident that members 30, 32, and 34 define three spaces or open regions 36 within and spaced along frame 11, these regions being utilized with a subsequently described aspect of the present invention.

The outward two of the members 32 are each provided with two arcuate surfaces or saddles 40 which conform to the circumferences of two bombs disposed in the above-described shipping arrangement. It is thus apparent that frame 11 is configured to receive and engage bomb portions 26 when the bombs are disposed on the frame in the depicted parallel and adjacent relation. It is also apparent that frame 11 lies generally along a plane intersecting the bombs at these portions 26 when the frame and the bombs are in such an article shipping arrangement. It is further apparent that, in such an arrangement, the bomb or bombs are disposed between frames 11 and 12 with their axes disposed between the frames and that the lifting lugs 22 extend from each bomb oppositely of the bottom frame.

Bottom frame 11 is adapted for conventional handling and storage of pallet 10 by elements which are not a portion of the present invention and include skids 45 extending along each longitudinal member 30 beneath members 32 and include lift eyes 46 disposed in the open ends of transverse members 32. These open ends also adapt the pallet for use with forklift equipment.

Each connecting member or A-frame 13 has a pair of legs 50 terminating in ends 51, which are referred to in the claims as a "first portion" of the connecting member, and have individual bores, not shown, about a common pivotal axis. The legs diverge from and are spaced from a joined A-frame end 53, referred to in the claims as a "second portion", which screw-threadably receives a fastener or conventional cap screw 55 having a head 56. The cap screw is preferably captured in the end 53 in any suitable manner, not shown. The axis of the cap screw is substantially normal to the just-mentioned pivotal axis, and each end 53 terminates in a surface normal to the cap screw axis, one such surface being shown in FIG. 4 and there identified by numeral 57.

Figure 3:
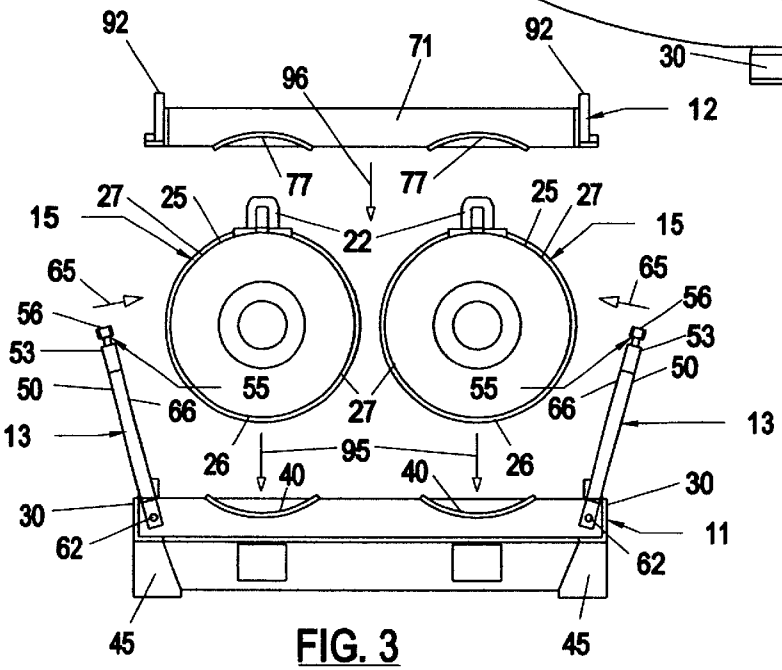
FIG. 3 is an elevation of the pallet and the two articles in a separated disposition with arrows indicating movement of the pallet and articles to attain the arrangement of FIG. 2.
Figure 4:
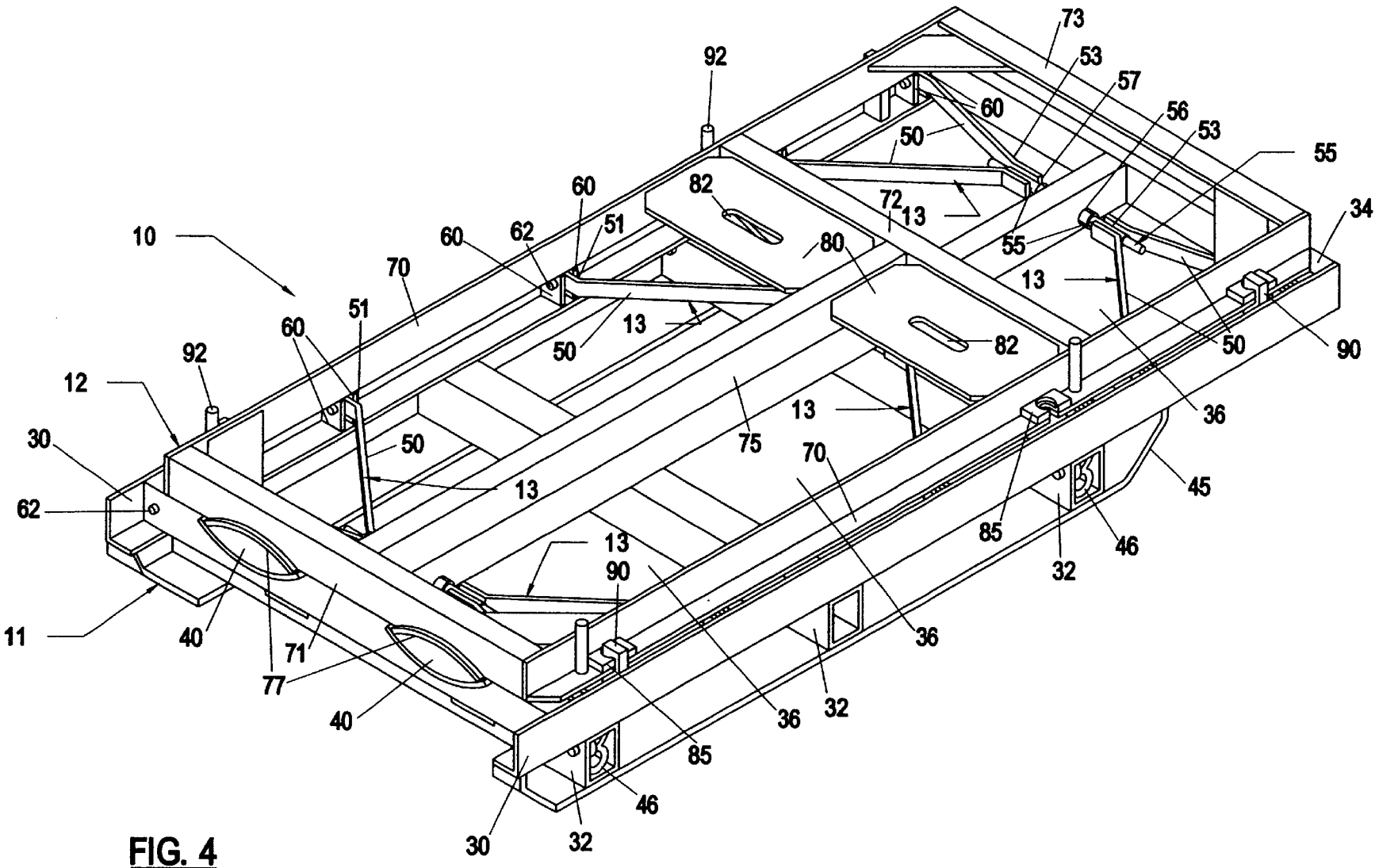
FIG. 4 is an isometric view of a bottom frame and a top frame of the pallet in a return shipping arrangement.

As best seen in FIG. 4, bottom frame 11 has twelve plate pairs 60 mounted on and adjacent to the longitudinal members 30 and having bores, not shown, parallel to the axes of bombs 15 when the bombs are received on the bottom frame. As maybe envisioned from FIGS. 1 and 3, the axes of these bores are disposed in a plane which is parallel to the axes of bombs 15 in above-described article shipping arrangement and is at the bottom bomb portions 26. Six of the plate pairs are disposed on each member 30 at the side thereof toward the open regions 36, with the two pairs at each of the regions spaced to receive the leg ends 51 of one of the A-frames 13. The above-mentioned bores in the leg ends and in the plate pairs are aligned, and any suitable pivot 62 extends through these bores thereby mounting three of the A-frames on each of the members 30 for pivotal movement relative to the bottom frame. This movement provides for pivoting the A-frame ends 53 in the direction indicated by arrows 65 in FIG. 3 between a first or loading position indicated therein by numeral 66 and a second or article shipping position indicated by numeral 67 in FIG. 1.

When no article such as a bomb 15 is received on the bottom frame 11, each A-frame 13 may be pivoted further in direction 65 into the corresponding open region 36 as shown in FIG. 4 so that the bottom frame has a generally planar return shipping configuration shown in FIG. 4.

It is apparent from the above description that the bottom frame 11 bears a plurality of the pivots 62 and that each pivot corresponds to an A-frame 13 which is individually connected by the pivot to the bottom frame. It is also apparent that the open regions 36 are adjacent to the pivots. It is further apparent that there a region 36 adjacent to and extending along the two pivots corresponding to each A-frame, and that this region is configured to receive the A-frame.

It can be seen from the Figures that top frame 12 is of generally planar configuration and includes a pair of outer longitudinal angle members 70 disposed so as to be aligned with bottom frame members 30 when frames 11 and 12 are in the above-described article shipping arrangements shown in FIGS. 1 and 2. Members 70 are connected by three transverse members 71, 72 and 73 spaced along members 70 so that, in such an arrangement, members 71 and 72 are aligned with the two bottom frame members 32 provided with saddles 40, and so that member 73 is aligned with bottom frame member 34. A third longitudinal member 75 interconnects members 71 and 72 centrally between members 70. Members 71 and 72 are each provided with two arcuate surfaces or inverted saddles 77 which conform to the circumferences of two bombs disposed in such shipping arrangements including the arrangement with the bombs in the parallel and adjacent relation shown in FIG. 2. It is thus apparent that top 12 is configured to receive and engage the top portion 25 of a bomb or bombs 15 when the bottom frame engages the bottom portion 26 of the bomb or bombs the bomb or bombs are in such article shipping arrangement.

Top frame 12 includes a pair of plate-like members 80 which extend oppositely from member 75 to members 70 and are at the side of member 72 toward member 71. These members 80 are disposed at the bomb lifting lugs 22 spaced farthest from bomb nose portions 21 when frames 11 and 12 and bombs 15 are in the article shipping arrangement shown in FIG. 1.

Each member 80 is provided with an opening or slot 82 which, in such arrangement, receives and engages the corresponding lifting lug so that engagement of the lug by the top frame at the slot retains the article from moving axially and rotationally in relation to bottom frame 11 and to top frame 12 when these frames are connected by A-frames 13 in a manner which will now be described.

Each longitudinal member 70 has three outwardly opening, countersunk, U-shaped notches 85, best shown in FIG. 4 and corresponding to the ends 53 of the three of the A-frames 13 mounted on the transversely corresponding bottom frame member 30. The notches are disposed so as to individually receive the cap screws 55 of these A-frames when the cap screw heads 56 are extended from the A-frame ends 53 and the A-frames are pivoted into their article shipping positions indicated by numeral 67 in FIG. 1. In these positions, A-frame end surfaces 57 engage the members 70 oppositely of the cap screw heads so that tightening the heads against the longitudinal members 70 by rotation of the cap screws engages the heads thereof with these members so as to connect the A-frame ends 53, and thus the A-frames 13 and the bottom frames 11, rigidly to the top frame 12.

It is evident that, as a result of this rotation and connection, the bottom frame 11, the top frame 12, and the A-frames 13 are retained in the same relative positions in article shipping arrangements corresponding to one bomb 15 as shown in FIG. 1 or to two bombs as shown in FIG. 2. It is also evident that the cap screws, selectively, serve to releasably attach the A-frame ends 53 to the top frame in these arrangements and, by opposite rotation of the cap screws, serve to detach the ends 53 from the top frame and to release the frames and the bomb or bombs from these arrangements. It is further evident that, in the article shipping position 67, the A-frame ends 53 are adjacent to the top frame while, in the loading position 66, these ends are spaced from the top frame.

In view of the above-described disposition of the connecting members or A-frames 13 in relation to bottom frame 11 and top frame 12 and to the bomb or bombs 15 in article shipping arrangements shown in FIGS. 1 and 2, it is apparent that a plurality of the A-frames are mounted on the bottom frame at locations disposed oppositely of the bomb or bombs when received on the bottom frame in these arrangements. In these arrangements it is also apparent that the A-frames extend between the bottom frame and the top frame and that a plurality of the A-frames and are disposed oppositely of the bomb or bombs and the transversely opposite sides 27 thereof.

Referring now to FIG. 4 where pallet 10 is shown with no bomb 15 disposed between bottom frame 11 and top frame 12 and the bottom frame is in the above-described generally planar return shipping configuration with A-frames 13 pivoted into open regions 36, it is evident that the top frame also has a generally planar configuration and is thus configured to engage the bottom frame in generally parallel relation to place the pallet in an unloaded, compact return shipping arrangement depicted in FIG. 4 when the frames are juxtapositioned in generally parallel relation. It can be seen from FIG. 4 that bottom frame 11 has projections 90 extended from it and disposed to enter notches 85 of top frame 12 when the frames are so juxtapositioned, and that these projections retain the frames in transversely aligned relation when the frames are in such return shipping arrangement.

It can also be seen from FIG. 4 that top frame 12 has four pins 92 disposed near the ends of members 71 and 72 and extended therefrom so as to enter corresponding openings, not shown, in the bottom frame 11 of another pallet, such as pallet 10, disposed in the return shipping arrangement and stacked on the depicted pallet. As a result, any reasonable number of the pallets in such arrangement may be retained in stacked relation.

The operation of a pallet, such as pallet 10, for loading and retaining articles such as bombs 15 will be apparent from FIG. 3 wherein the bombs, with their lugs 22 upwardly extended, are lifted in any suitable manner above bottom frame 11 which is disposed with A-frames 13 in their loading positions 66. The bombs are then lowered into engagement with saddles 40 as indicated by arrows 95. The top frame 12 is then lowered, as indicated by arrow 96, so that its inverted saddles 70 engage the bombs and the lugs 22 enter the slots 82. The A-frames are then pivoted, as indicated by arrows 65, into their shipping positions 67 with cap screws 55 entered into notches 85, and the cap screws tightened to retain the frames and bombs together for handling and shipping.

It is thus evident that pallet 10 and articles such as generally cylindrical bombs 15 are retained and the pallet assembled by conveniently connected pivoting elements without the use of strapping; that the lifting lugs 22 are always accessible and the bombs need not be rotated to retain the bombs on the pallet. From FIGS. 1 and 2, it is evident that the pallet is adapted for a plurality of the articles, but may be used for a single article; and from FIG. 4, it is apparent that the pallet folds into a compact arrangement when empty.

Although the present invention has been herein shown and described in connection with what is conceived as the preferred embodiment, it is recognized that departures may be made therefrom within the scope of the invention. Which is not limited to the illustrative details disclosed.

What is claimed is:

1. A pallet for shipping an article, the pallet comprising:

a first member configured to receive one side of the article;

a second member configured to receive another side of the article when the first member receives the article;

a plurality of connecting member each having a first portion and a second portion spaced from the first portion, the first portion being connected to the first member for movement of the second portion between a first position spaced from the second member when the second member receives the article and a second position juxtapositioned to the second member when the second member receives the article;

a plurality of pivots for the movement of the plurality of connecting members between the first position and the second position, the pivots being disposed at a plane and corresponding to each of the plurality of connecting members, and fastener means for releasably attaching the second portions to the second member when the connecting members are in the second position so as to retain the first member, the article, and the second member in a shipping configuration, and for releasing the first member, the article, and the second member from the shipping configuration.

2. The pallet of claim 1 wherein said fastener means comprises screw-threaded elements receivable in said second portions of each of said connecting members and receivable in said second member.

3. The pallet of claim 2 wherein:

at least two of the connecting members are mounted on the first member at locations disposed oppositely of the article when the article is received on the first member; and when the first member, the article, and the second member are in the shipping configuration, the two connecting members extend between the first member and the second member and are disposed oppositely of the article.

4. The pallet of claim 3 wherein the fastener means comprises screw-threaded elements receivable in the second portions of each of the connecting members and receivable in the second member.

5. The pallet of claim 3 wherein the first member defines a plurality of spaces corresponding individually to the connecting members, the space corresponding to each connecting member being disposed adjacent to the connecting member and being configured to receive the connecting member when no article is received by the first member and when the connecting member is pivoted in a direction from the first position through the second position into the space.

6. The pallet of claim 1 wherein:

the first member defines an open region adjacent to each of the plurality of pivots and extending along the predetermined plane for receiving each of the plurality of connecting members corresponding to each of the plurality of pivots; and each of the plurality of connecting members are pivotable from the second position into the corresponding open region, so that, when no article is disposed within the pallet and when each connecting member is pivoted into the corresponding open region, the first member has a generally planar return shipping configuration.

7. The pallet of claim 6 wherein:

the second member has a generally planar configuration and is configured to engage the first member in generally parallel relation when the first member is in the return shipping configuration; and the pallet further comprises means extending between the first member and the second member for retaining the members in a transversely aligned return shipping relation when the second member is juxtapositioned in generally parallel relation with the first member and when the first member is in the return shipping configuration, so that the pallet has a compact configuration for shipping the first and second members when no article is disposed between the members.

8. The pallet of claim 1 wherein the article is one article of a predetermined plurality of the articles having predetermined configurations and wherein in the pallet:

the first member is configured to engage the plurality of the articles when said plurality of the articles are disposed on the first member in a predetermined, adjacent relation;

the second member is configured to engage the plurality of the articles disposed on the first member in the adjacent relation;

the plurality of connecting members are disposed on the first member so that, in an article shipping arrangement, a plurality of the connecting members extend between the first member and the second member and transversely oppositely of said plurality of the articles disposed on the first member in the adjacent relation;

in the article shipping position, the second portion of each of the plurality of the connecting members engages the second member; and in the article shipping position, the fastener means connects the second portions of the plurality of connecting members rigidly to the second member, so that the first member and the second member are retained in the same relative positions as in the article shipping arrangement when a number of the articles less than the plurality of said articles are disposed on the first member, whereby the first member, the second member, and the number of the articles less than the plurality are retained in an article shipping arrangement corresponding to the number of the articles.

9. The pallet of claim 8 wherein the article is generally cylindrical and has a handling element extended radially from the circumference of the article and disposed in a predetermined position axially of the article, and wherein in the pallet:

the bottom frame and the top frame bear surfaces conforming to the circumference of the article when the article is disposed between the frames in a predetermined such article shipping arrangement wherein the axis of the article is disposed between the frames and the handling element extends from the article oppositely of the bottom frame; and the top frame defines an opening disposed to receive the handling element when the article is disposed between the frames in the predetermined article shipping arrangement, so that, in the predetermined article shipping arrangement, the engagement of the handling element by the top frame at the opening retains the article from moving axially and rotationally in relation to the frames.

* * * * *